US008882566B2

(12) United States Patent
Okamura et al.

(10) Patent No.: US 8,882,566 B2
(45) Date of Patent: Nov. 11, 2014

(54) METHOD OF MACHINING OPPOSITE ENDS OF ROD MEMBERS

(75) Inventors: Yuji Okamura, Hadano (JP); Yosuke Makino, Hadano (JP)

(73) Assignee: Nittan Valve Co., Ltd., Kanagawa (JP)

( * ) Notice: Subject to any disclaimer, the term of this patent is extended or adjusted under 35 U.S.C. 154(b) by 0 days.

(21) Appl. No.: 14/113,088

(22) PCT Filed: May 15, 2012

(86) PCT No.: PCT/JP2012/062405

§ 371 (c)(1), (2), (4) Date: Oct. 21, 2013

(87) PCT Pub. No.: WO2013/171845

PCT Pub. Date: Nov. 21, 2013

(65) Prior Publication Data

US 2014/0227946 A1 Aug. 14, 2014

(51) Int. Cl.
*B24B 5/00* (2006.01)
*B42B 9/00* (2006.01)

(52) U.S. Cl.
CPC .... *B42B 9/00* (2013.01); *B42B 5/01* (2013.01)
USPC ..... 451/49; 451/57; 451/58

(58) Field of Classification Search
CPC ..... B24B 5/01
USPC ..... 451/49, 57, 58
See application file for complete search history.

(56) References Cited

U.S. PATENT DOCUMENTS 3,342,107 A * 9/1967 Margolien ..... 409/205
4,412,401 A * 11/1983 Fundell ..... 451/242
5,259,146 A * 11/1993 Jinkins ..... 451/49
5,564,871 A * 10/1996 Lagsdin ..... 409/138
6,129,488 A 10/2000 Fahr (Continued)

FOREIGN PATENT DOCUMENTS

JP 11-503372 A 3/1999
JP 11-282519 A 10/1999

(Continued)

OTHER PUBLICATIONS

International Search Report dated Jun. 12 2012, issued in corresponding application No. PCT/JP2012/062405.
Written Opinion dated Jun. 12, 2012, issued in corresponding application No. PCT/JP2012/062405.

* cited by examiner

*Primary Examiner* — Maurina Rachuba
(74) *Attorney, Agent, or Firm* — Westerman, Hattori, Daniels & Adrian, LLP

(57) ABSTRACT

A method of efficiently cutting and machining opposite ends of rod members in sequence is provided, which comprises steps of: abutting a grinding wheel (5) against the periphery of a long rod material (10*a*) placed at a predetermined work position; moving the grinding wheel towards and along the axis of a first portion of the long rod material (10*a*) in rotation to taper the tail end of the first portion (to be provided as a rod member); and then moving the grinding wheel (5) further towards the axis of the rod material (10*a*) to cut the first portion off the long rod material and at the same time chamfer the leading end of a second portion of the long rod material in contact with the rear side of the grinding wheel. After removing the first rod member cut off, the sequence of these steps is repeated as needed.

5 Claims, 4 Drawing Sheets

(56) References Cited

U.S. PATENT DOCUMENTS

| | | | | |
|---|---|---|---|---|
| 6,431,954 | B1 * | 8/2002 | Junker | 451/11 |
| 6,938,313 | B2 * | 9/2005 | Viola et al. | 29/33 T |
| 7,578,643 | B1 * | 8/2009 | Karow | 409/179 |
| 7,775,752 | B2 * | 8/2010 | Karow | 409/132 |

FOREIGN PATENT DOCUMENTS

| | | | |
|---|---|---|---|
| JP | 2000-024930 | A | 1/2000 |
| JP | 2002-233908 | A | 8/2002 |
| JP | 2003-020266 | A | 1/2003 |
| JP | 2005-014130 | A | 1/2005 |

METHOD OF MACHINING OPPOSITE ENDS OF ROD MEMBERS

TECHNICAL FIELD

This invention relates to a method of machining opposite ends of rod members with a grinding wheel.

BACKGROUND ART

Conventionally, machining of the opposite ends of a round rod member is performed by holding the rod member with a pair of rotating pinch rollers and moving the rod member towards a grinding wheel (Patent Document 1), one rod member at a time.

PRIOR ART DOCUMENT

Patent Document

Patent Document 1: JPA Laid Open 2005-14130

SUMMARY OF THE INVENTION

Problems to be Solved by the Invention

In the prior art method mentioned above, rod members must be cut in advance to a predetermined finish length, and each end of the rod member must be machined separately. As a consequence, manufacture of round rod members having a predetermined length and chamfered ends is not efficient and requires a long machining time. Furthermore, need of independent facilities for such machining requires not only a high manufacturing cost but also a large work space.

It is, therefore, an object of the present invention to circumvent such drawbacks as mentioned above by providing a method of efficiently machining a long rod material into chamfered rod members with a grinding wheel.

Means for Achieving the Object

To achieve the object above, there is provided in accordance with the invention a method of machining opposite ends of round rod members, comprising steps of: moving a long round rod material to a predetermined work position; chamfering a first portion of the long rod material on a first (or front) side of a rotating grinding wheel; cutting off the first portion and chamfering the leading end of a second portion of the long rod material in contact with a second (or rear) side of the grinding wheel; removing away from the work position the first portion cut off, and moving the chamfered second portion to the work position; and repeating the above-mentioned steps as needed. More particularly, the first portion of the long rod material on the front side of the grinding wheel is tapered by moving, towards and along the axis of the rod material in rotation, the periphery of the rotating grinding wheel in abutment against the first portion until the taper end has a predetermined diameter. Then, in a step of cutting and chamfering the rod material, the periphery of the grinding wheel is further moved towards the axis of the long rod material to cut the long rod material at the taper end, and at the same time to chamfer the leading end of the second portion of the long rod material in contact with the rear side of the grinding wheel to a configuration defined by the rear end configuration of the grinding wheel.

Said cutting-and-chamfering step is preferably performed by: first, bringing the periphery of the grinding wheel into contact with the long rod material at a position slightly offset rearward from the taper end; second, moving the grinding wheel forward towards the taper end while slightly moving the grinding wheel towards the axis of the long rod material to thereby roughly grind the leading end of the second portion of the long rod material; and third, further moving the grinding wheel to the axis of the rod to cut the first portion off the long rod material and simultaneously finish chamfering of the leading end of the second portion of the long rod material in contact with the rear side of the grinding wheel to the shape defined by the rear side configuration of the grinding wheel.

The grinding wheel is generally disk-shaped, and has a rounded periphery. The grinding wheel has: a rounded periphery; a flat front side adjacent the periphery; an annular flat region on the rear side of the grinding wheel and adjacent the periphery; and a concave region inside the annular flat region, having a thickness that increases towards the center of the grinding wheel. By providing the grinding wheel with different configurations, various types of chamfering can be achieved.

Result of the Invention

By use of an inventive method of machining rod members, cutting and chamfering of rod members can be simultaneously achieved efficiently in sequence. Since this method enables simultaneous cutting and chamfering of each rod member in a fewer manufacturing steps, machining cost, space, and facility are cut down. Further, the method not only shortens work lead time but also produces no goods-in-progress.

BEST MODE FOR CARRYING OUT THE INVENTION

Referring to the accompanying drawings, the inventive method of cutting and chamfering opposite ends of rod members will now be described in detail by way of example with reference to an embodiment for manufacturing rod members of automobile engine valves. Automobile engine valves are generally manufactured from primary rod members by upset-forging the rod members with an upsetter. To do this a long rod material is first cut into rod members of a predetermined length. Then, one end of each rod member to be connected to the umbrella portion of a valve is chamfered to prevent the umbrella shaped bottom from getting wrinkled during forging. On the other hand, the other end is tapered to prevent the end from getting stuck with a mold when the rod member is inserted into the mold. The embodiment shown herein is a method of cutting and chamfering a long round rod material into chamfered rod members according to the invention.

Figure 1:
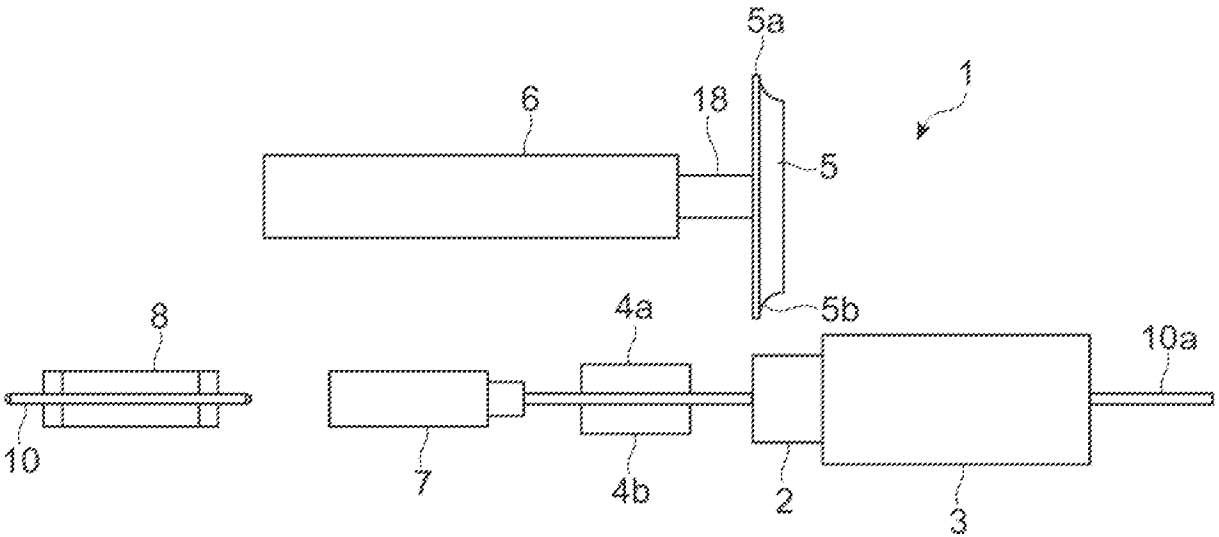
FIG. 1 is a schematic plan view of a machining apparatus for use in one embodiment of the invention.

First, a machining apparatus 1 for carrying out the invention will be briefly described before describing the method of this invention. As shown in FIG. 1, a machining apparatus 1 has a main spindle 3 equipped at the tip thereof with a gripping member 2 such as a collet chuck, holding members 4*a* and 4*b* such as a pair of rollers, a grinding table 6 equipped with a generally disk-shaped grinding wheel 5, a positioning member 7, and a temporary installation table 8.

The main spindle 3 is adapted to rotatably retain a long round rod material 10*a* inserted thereinto from the rear end of the main spindle 3. The inserted long rod material 10*a* is gripped by the gripping member 2, and rotated by a motor (not shown) for example in the clockwise direction when viewed from the rear end thereof. The holding members 4*a* and 4*b* are adapted to pinch the long rod material 10*a*, and freely rotatable in association with the rotating rod. One of the holding members 4*a* and 4*b*, say 4*a*, can be moved to and away from the other member 4*b*.

Figure 2:
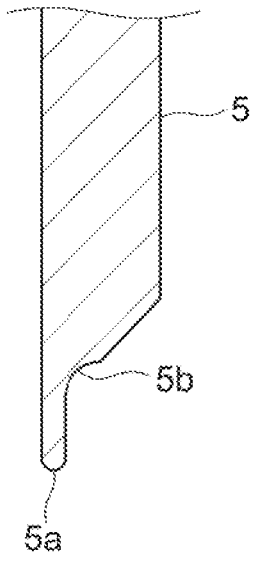
FIG. 2 shows in enlarged cross section a primary portion of a grinding wheel.

As shown in FIG. 2, the grinding wheel 5 has a circular periphery 5*a*, a flat surface on the front side of the circular periphery 5*a*, and, on the rear side of the circular periphery 5*a*, an annular flat surface and a concave surface 5*b* lying radially inside the annular flat surface. The thickness of the concave surface 5*b* increases towards its center. The grinding wheel 5 is not only rotatable in the opposite direction of the main spindle 3 but also movable in the axial direction (referred to as X direction) and in the transverse direction (referred to as Y direction) perpendicular to the axis of the main spindle 3.

As shown in FIG. 1, the long round rod material 10*a* inserted in the main spindle 3 from its rear end is abutted against the positioning member 7, which is movable to and away from the tip of the long rod material 10*a*. By adjusting the position of the positioning member 7, the length of a rod member to be cut from the long rod material 10*a* can be determined.

Figure 3:
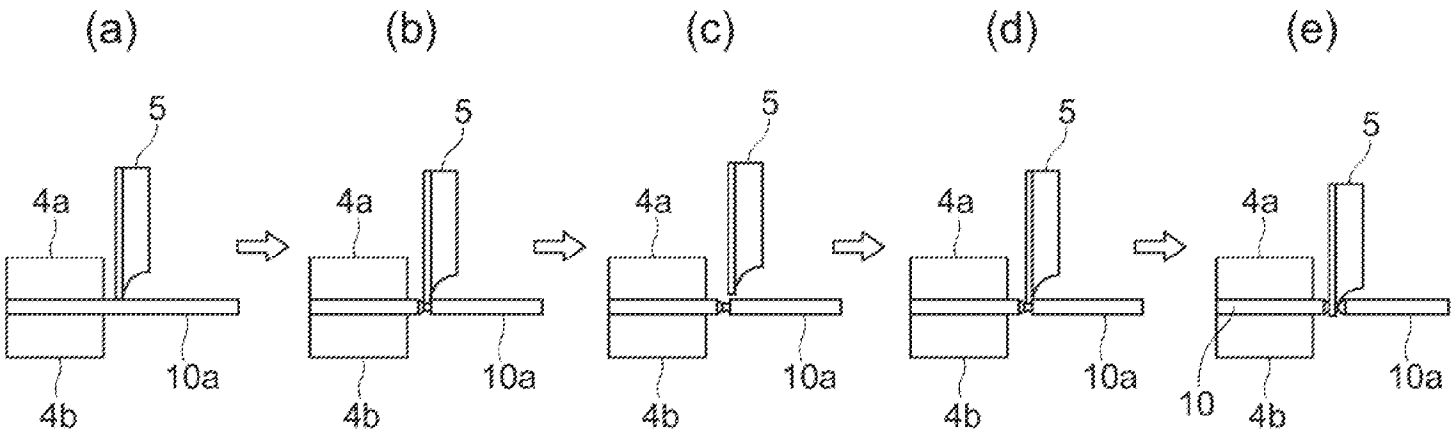
FIG. 3 is schematic diagram illustrating steps of machining operations.

Referring to FIG. 3, there is shown an inventive method of machining a long rod material into rod members. First, a long rod material 10*a* is transported from a warehouse storage (not shown) to a work position and passed through the main spindle 3 from the rear end thereof until it abuts against the positioning member 7. The position of the positioning member 7 is presumably determined in accord with the predetermined length of a rod member to be cut from the long rod material 10*a*. The rod material 10*a* thus positioned is grabbed on the opposite sides thereof by the paired holding members 4*a* and 4*b* and by the grip member 2, with the axis of the long rod material 10*a* retained coaxial with the main spindle 3 (FIG. 1).

Under this condition, the main spindle 3 is rotated in a predetermined direction to rotate the long rod material 10*a* in the same direction. At the same time, the grinding wheel 5 is also rotated in a predetermined direction, and is moved in X- and Y-directions until the periphery 5*a* of the grinding wheel 5 reaches a predetermined position relative to the long rod material 10*a*, where the periphery abuts on the periphery of the long rod material 10*a* when grinding is started. (FIG. 3*a*). In this grinding work, a portion of the long rod material 10*a*, located on front side of the grinding wheel facing the main spindle 3, is tapered. A desired tapering is achieved by appropriately moving the grinding wheel 5 in X- and Y-direction (FIG. 3*b*). In this case, the grinding wheel 5 is moved downward to the right in FIG. 3. When the taper end has a predetermined diameter, tapering is ended by lifting up the grinding wheel 5 off the long rod material 10*a* (FIG. 3*c*).

Next, a cutting-and-chamfering process is performed on the long rod material 10*a* as follows. In this process, the grinding wheel 5 is once moved in X- and Y-direction so as to move the grinding wheel 5 away from the taper end towards the main spindle 3 (FIG. 3*d*), and then moving the grinding wheel 5 in X-direction towards the taper end while slightly moving the grinding wheel also in Y-direction (FIG. 3*d*). It will be understood that at this stage the grinding wheel 5 is moved downward to the left in FIG. 3, thereby roughly chamfering the leading end of the second portion of the long rod material member 10*a* on the right side of the grinding wheel. Next, the grinding wheel 5 is further moved in Y-direction (towards the axis of the rod) to cut off the tapered end of the first rod member off the long rod material 10*a*, and at the same time finish chamfering of the leading end of the second portion of the long rod material 10*a* (FIG. 3*e*) using the concave face 5*b*. This completes the cutting-chamfering process. In this way, chamfering is performed in two stages, first in rough machining and second in finish chamfering, to thereby reduce the workload on the grinding wheel 5 and extend its life.

The cut rod member 10 is removed from the paired holding members 4*a* and 4*b* by loosening the holding member 4*a*, and transferred to a temporary storage area 8 using, for example, a loader (not shown). The tailing end of the very first rod member 10 thus machined is tapered, but its leading end that had been in abutment on the positioning member 7 is not worked at all.

Figure 4:
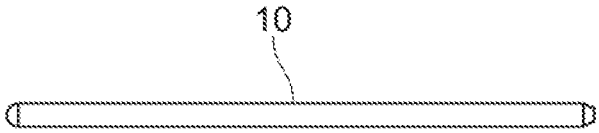
FIG. 4 is a plan view of a finished rod member having chamfered ends.

After the finished rod member is transferred to the temporary storage area 8, the gripping member 2 is loosened, and the remaining long rod material 10*a* having a chamfered leading end is moved forward until the chamfered end abuts on the positioning member 7. Then, the above sequence of tapering, cutting, and chamfering processes are repeated to obtain the next rod member 10 having one end tapered and the other end chamfered as shown in FIG. 4. This sequence is repeated as needed to obtain a multiplicity of such rod members 10.

It should be understood that the invention is not limited to the embodiment shown and described herein. The invention incorporates such modification that can manufacture rod members having arbitrary end configurations other than tapered and rounded ends. The opposite ends may have the same configuration. The grinding wheel 5 may have different configurations suitable for faceting or chamfering rod members to a preferred configuration.

SYMBOLS

1 machining apparatus
2 gripping member
3 main spindle
4*a* and 4*b* holding members
5 grinding wheel
7 positioning member
8 temporary storage area
10 round rod member
10*a* long round rod material

The invention claimed is:

1. A method of machining opposite ends of round rod members, comprising steps of:

moving a long round rod material to a predetermined work position;

abutting a rotating disk-shaped grinding wheel on the periphery of the long round rod material in rotation;

moving the grinding wheel towards, and along, the axis of the long rod material to chamfer a first portion of the long rod material on the front side the grinding wheel;

cutting and chamfering the long rod material by moving the grinding wheel towards the axis of the long rod material at a predetermined position of the first portion to cut said first portion off the long rod material, and at the same time to chamfer the leading end of a second portion of the long rod material in contact with the rear side of the grinding wheel;

moving the chamfered second portion of the long rod material to the work position after removing the first cut portion away from the work position; and repeating the above-mentioned steps as needed.

2. The method according to claim 1, wherein:

the step of chamfering the first portion is performed to taper that portion by moving, towards and along the axis of the rod material in rotation, the periphery of the rotating grinding wheel in abutment against the first portion until the taper end has a predetermined diameter; and the step of cutting and chamfering the rod material is performed by moving the periphery of the grinding wheel towards the axis of the rod material to cut the long rod material at the taper end, and at the same time to chamfer the leading end of the second portion of the long rod material in contact with the rear side of the grinding wheel to a configuration defined by the rear end configuration of the grinding wheel.

3. The method according to claim 2, wherein the step of cutting and chamfering the rod material is performed by first, bringing the periphery of the grinding wheel into contact with the long rod material at a position slightly offset rearward from the taper end;

second, moving the grinding wheel towards the taper end while slightly moving the grinding wheel towards the axis of the long rod material to roughly grinding the rod material; and third, further moving the grinding wheel towards the axis to cut the first portion off the long rod material and at the same time finish chamfering of the leading end of the second portion of the long rod material in contact with the rear side of the grinding wheel to the shape defined by the rear side configuration of the grinding wheel.

4. The method according to claim 2, wherein the grinding wheel is a disk in shape having:

a rounded periphery;

a flat front side adjacent the periphery;

an annular flat region on the rear side of the grinding wheel and adjacent the periphery; and a concave region inside the annular flat region, having a thickness that increases towards the center of the grinding wheel.

5. The method according to claim 3, wherein the grinding wheel is a disk in shape having:

a rounded periphery;

a flat front side adjacent the periphery;

an annular flat region on the rear side of the grinding wheel and adjacent the periphery; and a concave region inside the annular flat region, having a thickness that increases towards the center of the grinding wheel.

* * * * *